US006009296A

United States Patent [19]

Nishimura

[11] Patent Number: 6,009,296

[45] Date of Patent: Dec. 28, 1999

[54] MULTICOLOR IMAGE FORMATION DEVICE

[75] Inventor: Shigeki Nishimura, Iwatsuki, Japan

[73] Assignee: Fuji Xerox Co., Ltd., Tokyo, Japan

[21] Appl. No.: 09/276,684

[22] Filed: Mar. 26, 1999

[30] Foreign Application Priority Data

Apr. 9, 1998 [JP] Japan ..... 10-97206

[51] Int. Cl.[6] ..... G03G 15/01

[52] U.S. Cl. ..... 399/266; 399/178

[58] Field of Search ..... 399/223, 226, 399/228, 178, 51, 54

[56] References Cited

U.S. PATENT DOCUMENTS 4,885,611 12/1989 Higashio et al. ..... 399/223 X
5,162,853 11/1992 Ito et al. ..... 399/54
5,278,586 1/1994 Yoneda et al. ..... 399/178 X

*Primary Examiner*—Susan S.Y. Lee
*Attorney, Agent, or Firm*—Oliff & Berridge, PLC

[57] ABSTRACT

The object of the present invention is to obtain a multicolor image formation device wherein the defect of an image caused in switching developing machines and others can be prevented. A yellow latent image is formed by scanning a light beam on a photoconductor drum and developing is started by a developing machine for yellow. A developed yellow toner image is transferred on an intermediate transfer belt. Even if the transfer of the yellow toner image is finished, the developing machine for yellow is held a state opposite to the photoconductor drum. The developing machine for yellow is switched to a developing machine for magenta immediately before the scanning of a light beam corresponding to next magenta is started. Therefore, the defect of an image due to the effect of oscillation in switching the developing machines can be prevented. As minute toner is supplied to the photoconductor drum, the intermediate transfer belt is never bent and the defect of an image can be prevented from being caused by the effect of oscillation because the bent intermediate transfer belt is restored.

6 Claims, 13 Drawing Sheets

MULTICOLOR IMAGE FORMATION DEVICE

BACKGROUND OF THE INVENTION

The present invention relates to an image formation device such as an electrophotographic copying machine and a laser printer, particularly relates to a multicolor image formation device for forming an image using a rotary developing method.

Heretofore, an image formation device for forming an electrostatic latent image by radiating a light beam modulated based upon digital image data on the surface of a photoconductor uniformly electrified, developing the electrostatic latent image and forming a toner image, transferring the toner image on recording paper, fixing and outputting the toner image on the recording paper with a fixing device is known.

Also, recently, a multicolor image formation device for forming a color image is rapidly being popularized. For the above multicolor image formation device, a multicolor image formation device which is provided with a rotary developing unit in which developing machines corresponding to each chromatic component such as cyan, magenta, yellow and black of a color image to be formed are arranged circularly and which uses a so-called rotary developing method for opposing each developing machine to a photoconductor on which an electrostatic latent image of each chromatic component is formed by sequentially switching the developing machines by rotating the rotary developing unit and developing by corresponding color toner is often utilized.

Further, for the multicolor image formation device using the rotary developing method, there is a type that an image is formed on recording paper by collectively transferring a final toner image from an intermediate transfer member onto the recording paper after color toner images of each chromatic component formed on a photoconductor are sequentially transferred on the intermediate transfer member and the final toner image is formed on the intermediate transfer member.

Heretofore, developing machines are switched as shown in a timing chart in FIG. 9. FIG. 9 shows time required for scanning a light beam on a photoconductor, time required for supplying toner onto the photoconductor by a developing machine to develop, time required for switching developing machines, time in which a developing machine is opposite to the photoconductor and time required for transferring a toner image formed on the photoconductor on an intermediate transfer member in order from the top.

For example, a developing machine for a second color, magenta (M) is switched soon after the developing of a first color, yellow (Y) is finished, similarly a developing machine for a third color, cyan (C) and a developing machine for a fourth color, black (K) are switched.

When developing machines are switched, impact is applied to a photoconductor because the developing roll of a developing machine and the photoconductor are touched in developing. As a color toner image formed on a photoconductor is transferred on an intermediate transfer member when developing machines are switched (at timing shown by a dotted line in FIG. 9), the defect of an image occurs due to impact applied to the photoconductor as shown by a point D in FIG. 11 in such a case. In FIG. 11, the horizontal axis shows time and the vertical axis shows the degree of impact applied to a photoconductor drum by %.

To prevent the above defect of an image from occurring, operation for switching developing machines is divided into two as shown in a timing chart in FIG. 10, a developing machine is once withdrawn after the developing of yellow for example is finished and the developing machine is switched to a developing machine for magenta immediately before the developing of magenta is started.

However, according to the above method of dividing operation for switching developing machines into two, the following another problem further occurs.

As shown in FIG. 12, an intermediate transfer belt 160 is wound on a driving roll 154 and plural tension rolls 156 and is turned in a direction shown by an arrow Q in FIG. 12 by the rotational driving of the driving roll 154. The intermediate transfer belt 160 and a photoconductor drum 150 are rotated at the same speed, however, difference in speed occurs due to dispersion in a diameter between the driving roll 154 and the photoconductor drum 150. As the photoconductor drum 150 and the intermediate transfer belt 160 easily adhere, deflection shown by a dotted line in FIG. 12 is caused between a primary transfer device 158 and the driving roll 154.

As the above deflection produces the similar effect to effect in case lubricant exists between the intermediate transfer belt 160 and the photoconductor 150 if toner is supplied to the photoconductor drum 150 by a developing machine 152Y, the intermediate transfer belt 160 and the photoconductor 150 slip and no deflection is caused. However, if the developing machine 152Y is once withdrawn to a position in which the developing machine 152Y is not in contact with the photoconductor 150 after the developing of yellow is finished and is switched to the developing machine 152M for magenta immediately before the developing of magenta is started as shown in the timing chart in FIG. 10, toner is not supplied to the photoconductor drum 150 during switching and the above deflection is caused.

When the developing machine 152Y is switched to the developing machine for magenta 152M and toner is again supplied to the photoconductor drum 150, tension is rapidly applied to the intermediate transfer belt 160 bent till the time, impact due to this shown at a point E in FIG. 11 causes the variation in speed of the photoconductor drum 150 and the defect of an image is caused.

SUMMARY OF THE INVENTION

The present invention is made in view of the above facts and the object of the present invention is to provide a multicolor image formation device wherein the defect of an image caused in switching developing machines and others can be prevented.

To achieve the above object, the present invention disclosed in Aspect 1 is based upon a multicolor image formation device for forming an electrostatic latent image on an image carrier by scanning a light beam based upon each chromatic component of an image to be formed, opposing a developing machine to the above image carrier by sequentially switching plural developing machines provided every chromatic component, sequentially transferring a toner image of each chromatic component acquired by developing the above electrostatic latent image by toner of at least two colors on an intermediate transfer member and forming an image by collectively transferring the toner images on recording material afterward, and is characterized in that switching control means for controlling so that the above switching of developing machines is executed in a while after transfer on the intermediate transfer member is finished until scanning a light beam corresponding to a color to be developed next is started is provided.

According to the present invention disclosed in Aspect 1, the switching of developing machines is controlled by the switching control means so that it is executed immediately before scanning a light beam corresponding to a color to be developed next is started. The defect of an image caused because oscillation in switching developing machines is transmitted to the image carrier can be prevented by switching developing machines immediately before scanning a light beam corresponding to the next color is started or after transfer on the intermediate transfer member is fin-shed as described above. Further, minute toner can be always supplied to the intermediate transfer member. Therefore, as a minute slip can be caused between the image carrier and the intermediate transfer member and the deflection of the intermediate transfer member can be prevented, the defect of an image can be prevented from being caused by the effect of oscillation when the bent intermediate transfer member is restored.

The present invention disclosed in Aspect 2 is characterized in that withdrawal means for withdrawing any of the above plural developing machines in a predetermined position in which it is not opposite to the above image carrier after all toner images of each chromatic component are transferred on the above intermediate transfer member is further provided.

According to the present invention disclosed in Aspect 2, as any of the developing machines of each chromatic component is withdrawn in the predetermined position in which it is not opposite to the image carrier by the withdrawal means after all toner images of each chromatic component are transferred on the intermediate transfer member, the defect of an image can be prevented from being caused by the effect of oscillation due to the vibration of any of the developing machines.

The present invention disclosed in Aspect 3 is characterized in that the above intermediate transfer member is a belt without an end.

According to the present invention disclosed in Aspect 3, the intermediate transfer member is a belt without an end, the belt without an end is wound on a driving roll and tension rolls and is turned by the rotational driving force of the driving roll.

The present invention disclosed in Aspect 4 is characterized in that the above developing machine is provided with a tracking roll for maintaining a predetermined interval between the developing machine and the above image carrier and is touched to the image carrier via the tracking roll by pressing the developing machine by a spring member.

According to the present invention disclosed in Aspect 4, the developing machine is pressed by the spring member and is touched to the image carrier via the tracking roll of the developing machine.

The present invention disclosed in Aspect 5 is characterized in that the above image carrier is a cylindrical photoconductor drum and the other end of the photoconductor drum is fitted to the shaft of a driving motor and supported by the shaft when a housing for supporting one end of the photoconductor drum so that the photoconductor drum can be rotated is installed in a frame to which the driving motor of the photoconductor drum is fixed.

According to the present invention disclosed in Aspect 5, the image carrier is a cylindrical photoconductor drum and the other end of the photoconductor drum is fitted to the shaft of a driving motor and supported by the shaft when a housing for supporting one end of the photoconductor drum so that the photoconductor drum can be rotated is installed in a frame to which the driving motor of the photoconductor drum is fixed.

Further, according to the present invention disclosed in Aspect 6, there is provided with a multicolor image formation method for forming an electrostatic latent image on an image carrier comprising the steps of:

(1) scanning a light beam based upon each chromatic component of an image to be formed, (2) forming an electrostatic latent image on the image carrier, (3) sequentially transferring a toner image of each chromatic component acquired by developing the electrostatic latent image with toner of at least two colors on an intermediate transfer member, (4) sequentially switching plural developing machines provided every chromatic component to oppose a developing machine to the image carrier, (5) scanning a light beam corresponding to a color to be developed next, (6) forming an image by collectively transferring on recording material afterward.

DETAILED DESCRIPTION OF THE PREFERRED EMBODIMENTS

Figure 1:
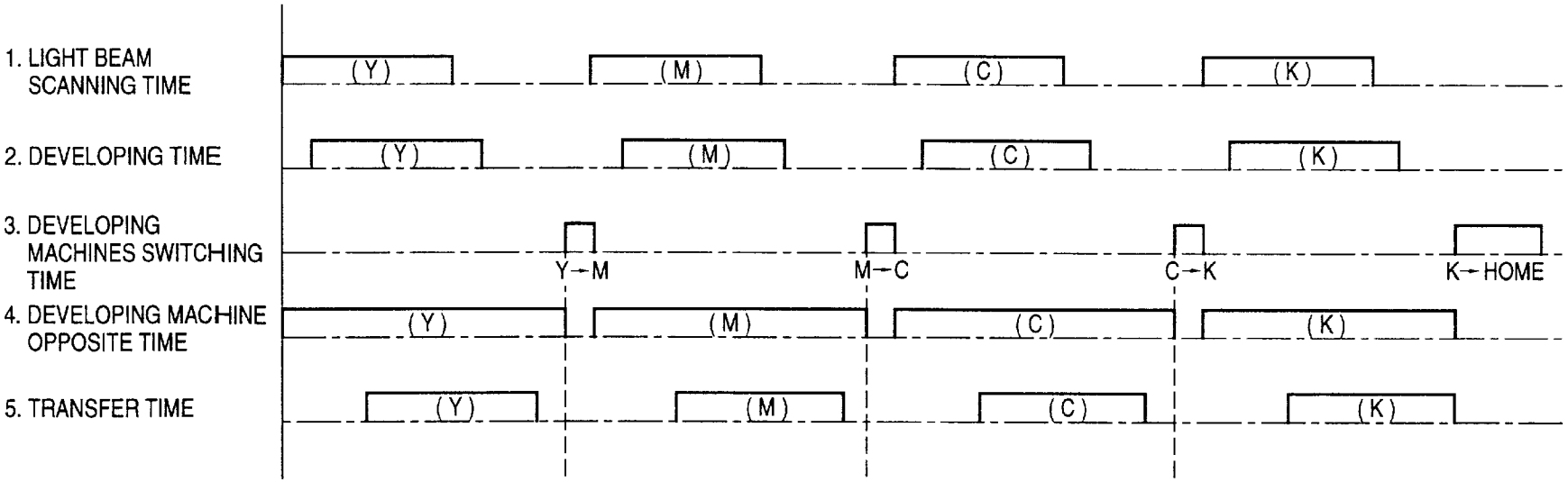
FIG. 1 is a timing chart for explaining timing for switching developing machines according to the present invention.

Referring to the drawings, preferred embodiments of the present invention will be described in detail below.

Figure 2:
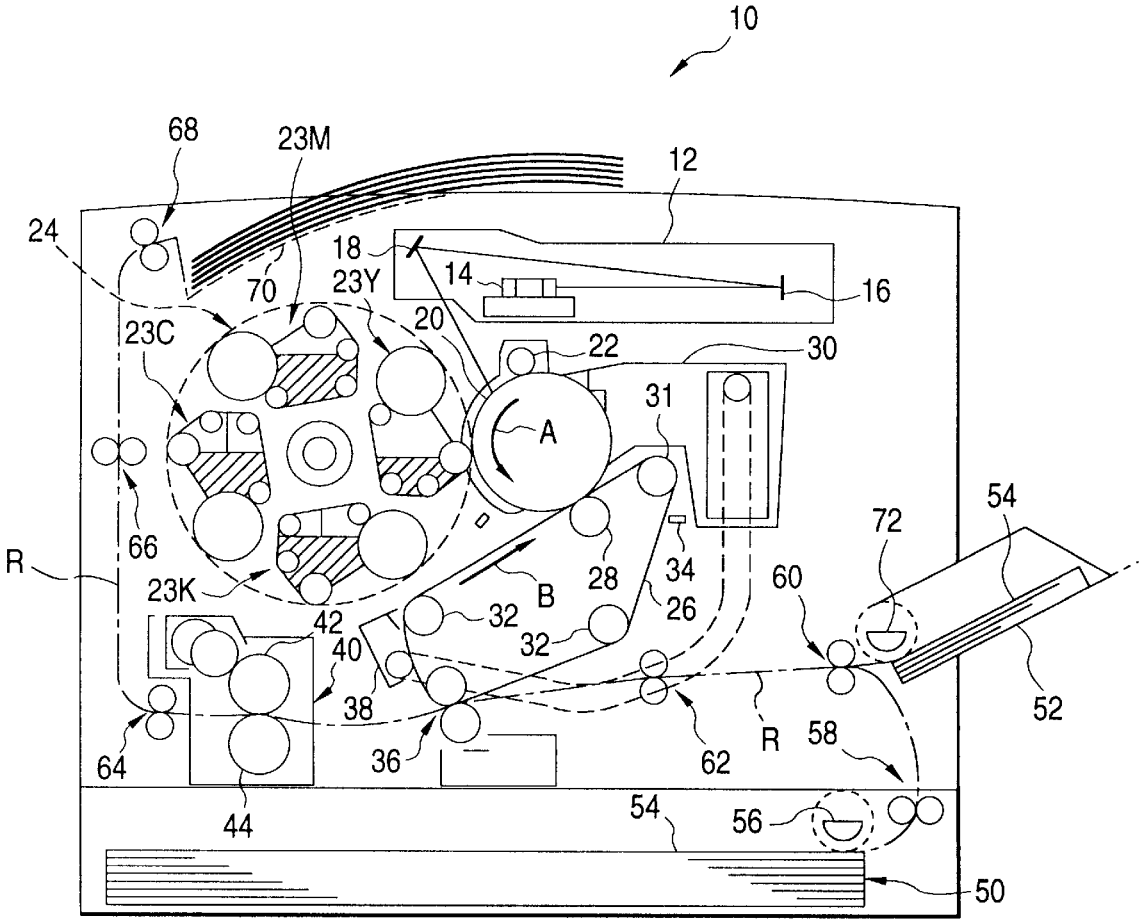
FIG. 2 is the whole block diagram showing an image formation device.

FIG. 2 is the whole block diagram showing an image formation device 10. As shown in FIG. 2, a laser beam emitting section 12 for emitting a laser beam modulated based upon the digital image data of an image to be formed and scanning the surface of a photoconductor drum 20 as an image carrier is provided to the image formation device 10.

A semiconductor laser, a laser driving circuit for controlling the on/off of the semiconductor laser based upon digital image data and a laser luminous energy variable device for varying the luminous energy of the laser are provided to the laser beam emitting section 12 though they are not shown. A laser beam from the semiconductor laser is deflected by a polygon mirror 14 and is led to the photoconductor drum 20 via an fθ lens not shown, a cylindrical mirror 16, a reflector 18 and others.

An electrifying device 22, a rotary developing system 24, an intermediate transfer belt 26, a primary transfer device 28 and a cleaner 30 for cleaning toner on the photoconductor drum 20 are arranged around the photoconductor drum 20. Developing machines 23Y to 23K of each color, yellow (Y), magenta (M), cyan (C) and black (K) are provided to the rotary developing system 24 and developing machines for executing developing processing are switched by rotating the rotary developing system 24 by 90 degrees.

Figure 3:
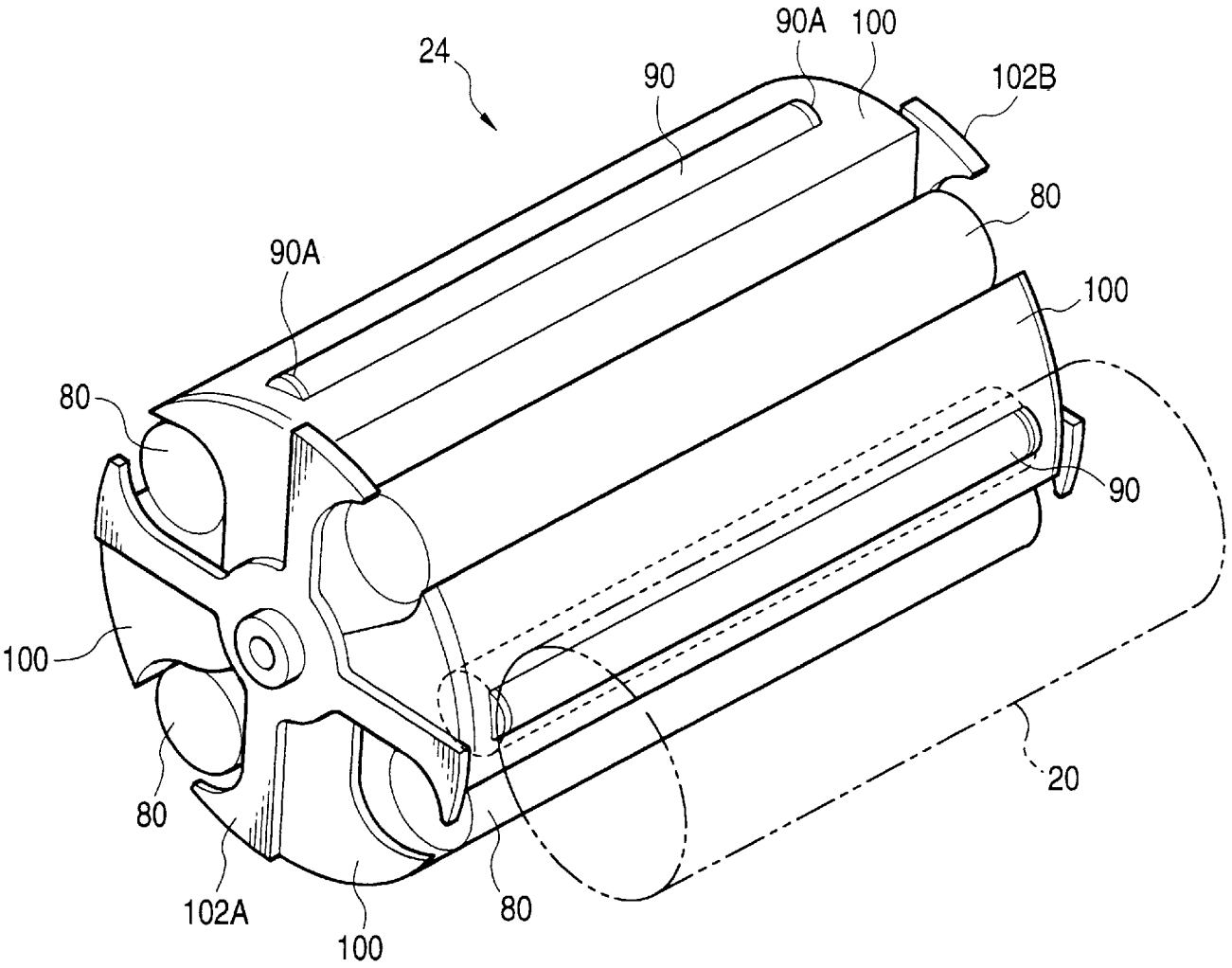
FIG. 3 is a schematic block diagram showing a rotary developing system.

The rotary developing system 24 is constituted as shown in FIG. 3. The rotary developing system 24 is composed of side frames 102A and 102B and a housing 100 housing the developing machines 23Y to 23K and is rotated by a motor not shown.

Figure 4:
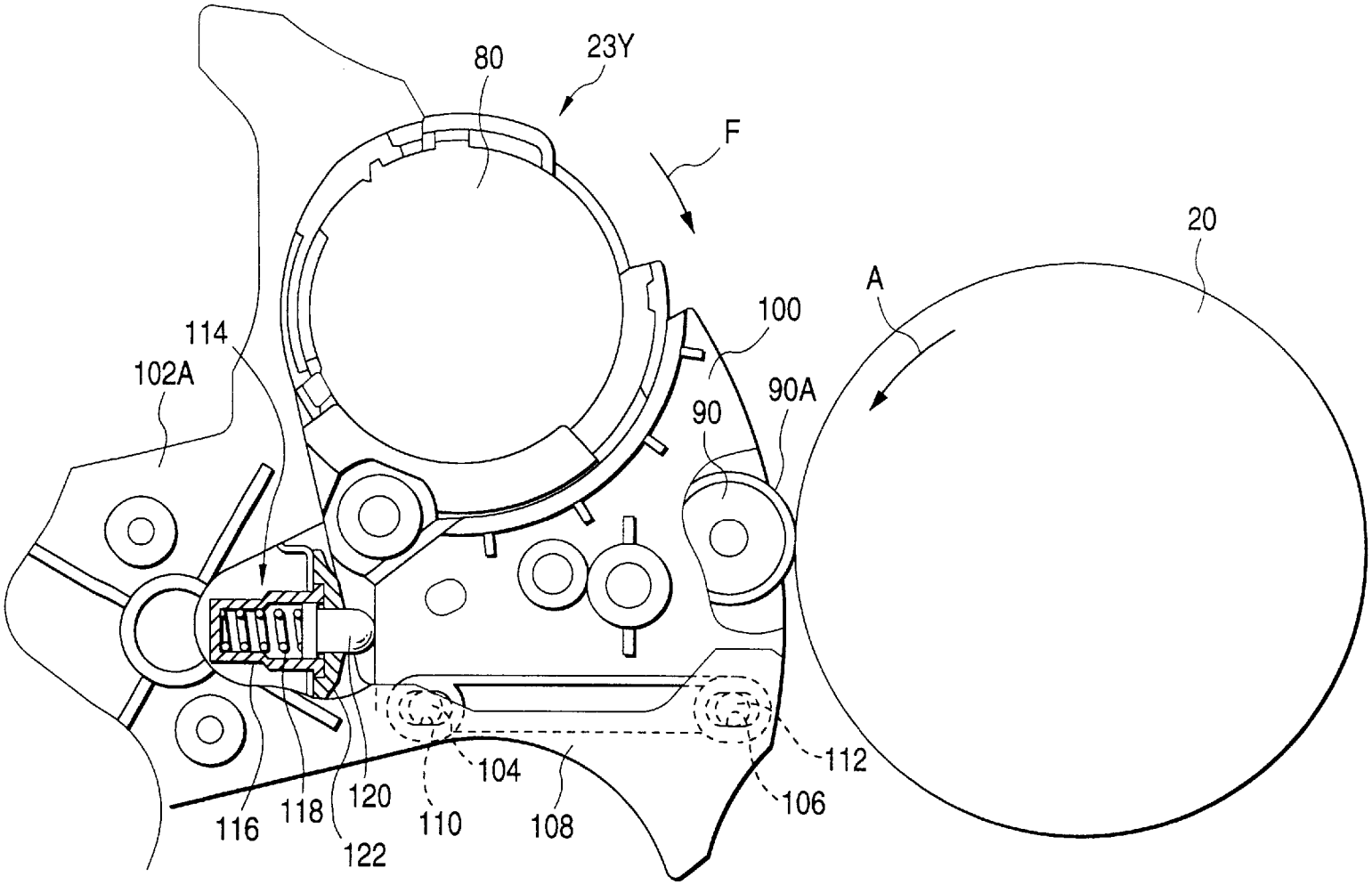
FIG. 4 is an enlarged view showing the main part of the rotary developing system.

FIG. 4 is an enlarged view showing the main part of the rotary developing system 24. A developing roll 90 is in contact with the photoconductor drum 20 via a tracking roll 90A. Long holes 104 and 106 are provided to the side of the housing 100 of the developing machines 23Y and pins 110 and 112 fixed to each arm 108 of the side frames 102A and 102B are respectively fitted into the long holes 104 and 106. The similar long holes and pins are also provided to the other side of the housing 100 and the side frame 102B. That is, the housing 100 storing the developing roll 90 is supported by the side frames 102A and 102B via the pins 110 and 112.

A pressing unit 114 for pressing the housing 100 toward the photoconductor drum 20 is provided at the back of the housing 100. The pressing unit 114 is composed of a cylinder 116 fixed to a main frame not shown, a helical compression spring 118 housed inside the cylinder 116 and a pressurizing pin 120 pressed by the helical compression spring 118. A stroke is regulated by a cover 122 provided on the cylinder 116 to prevent the pressurizing pin 120 from being detached from the cylinder 116. The end of the pressurizing pin 120 confronts the rear of the housing 100 so that the housing 100 is pushed forward by the spring of the helical compression spring 118 and the developing roll 90 is touched to the photoconductor drum 20 via the tracking roll 90A.

Figure 5:
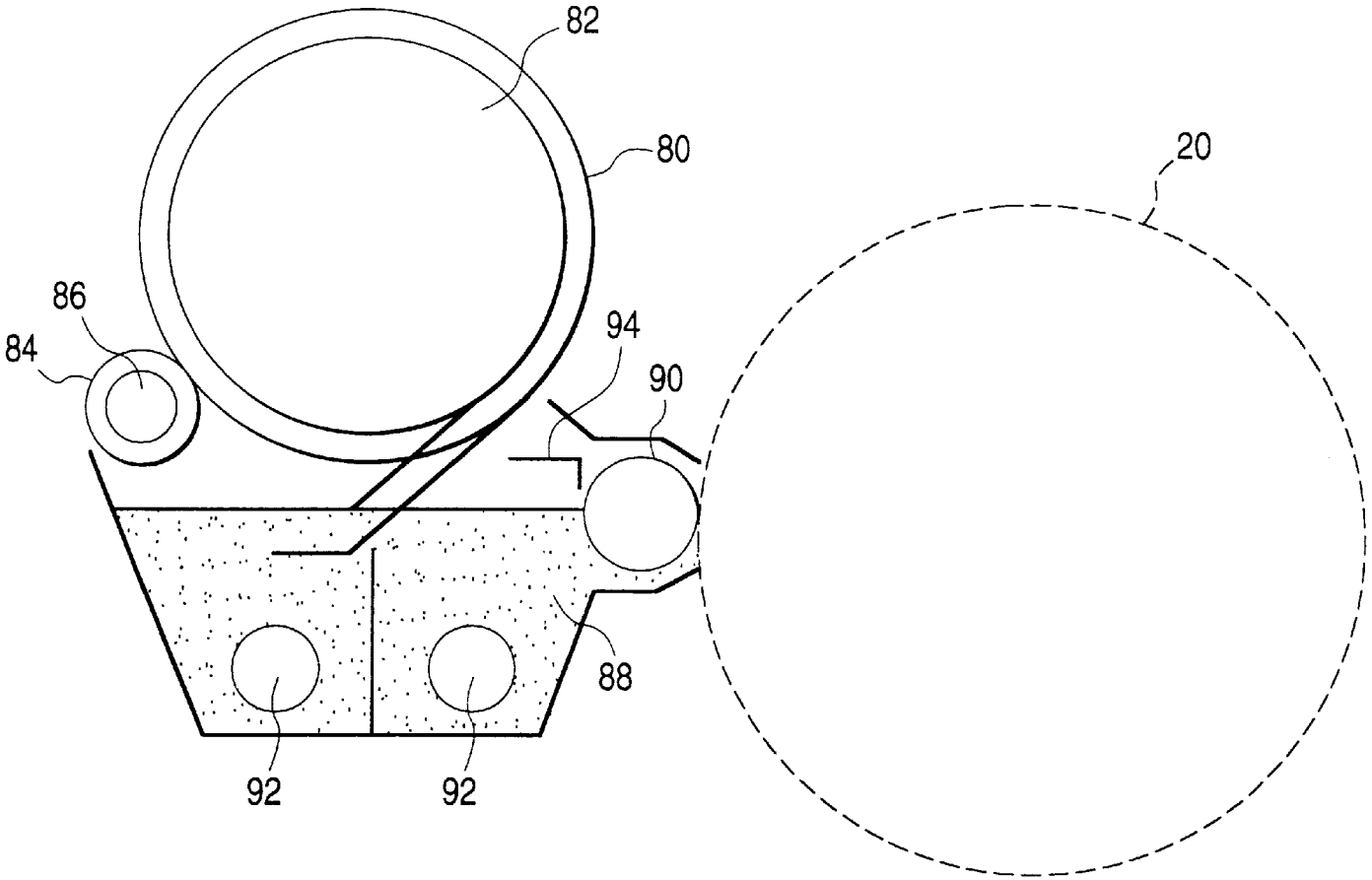
FIG. 5 is a schematic block diagram showing a developing machine.

The developing machine 23Y is constituted as shown in FIG. 5. As the developing machines 23C to 23K are constituted as the developing machine 23Y, the detailed description of them is omitted.

In the developing machine 23Y, toner 82 supplied from a toner cartridge 80 and developer 88 composed of carriers are filled, are circulated and carried by a developer circulating and carrying roll 92. The toner 82 is supplied via a toner supply roll 86 and a toner supply pipe 84.

The developer 88 is magnetically absorbed in the developing roll 90 and the thickness is regulated by the rotation of the developing roll 90 when the developer passes a thickness regulating member 94. The developer is carried to a position opposite to the photoconductor drum 20 and toner according to a latent image formed on the photoconductor drum 20 touched to the developing roll 90 is applied to develop.

Figure 6:
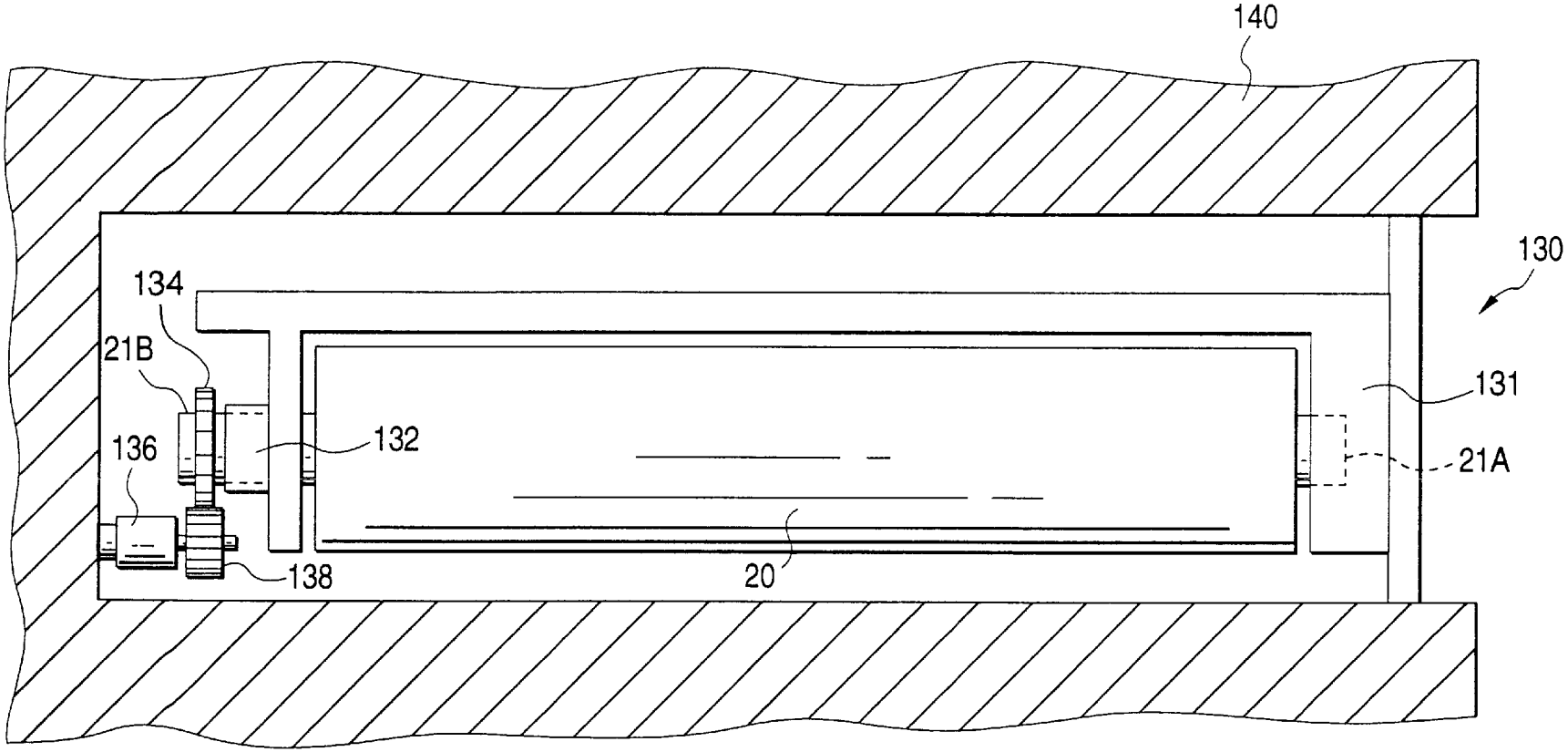
FIG. 6 shows a state in which a photoconductor unit is installed in a frame to which the driving motor of a photoconductor drum is fixed.

The shaft 21A of the photoconductor drum 20 is supported by a housing 131 so that the photoconductor drum can be rotated as shown in FIG. 6. One shaft 21B is supported by the bearing 132 of the housing 131 and a gear 134 is attached to the end. The gear 134 is engaged with a gear 138 attached to a motor 136 and the photoconductor drum 20 is rotated by the driving force of the motor 136. The motor 136 is fixed to a frame 140. The photoconductor drum 20 can be attached or detached to/from the frame 140 with the photoconductor drum housed in the housing 131 as a photoconductor unit 130 and when the photoconductor drum is installed in the frame 140, the gear 134 attached to the shaft 21B of the photoconductor drum 20 is engaged with the gear 138 attached to the motor 136.

In the meantime, the intermediate transfer belt 26 is a belt without an end, is wound on a driving roll 31 and tension rolls 32 and is in contact with the photoconductor drum 20. The intermediate transfer belt 26 is turned in a predetermined direction (shown by an arrow B) along a predetermined path by the driving force of the driving roll 31.

A reference position detecting sensor 34 for detecting a preset reference position on the intermediate transfer belt 26 by detecting a predetermined mark provided on the surface of the intermediate transfer belt 26 and outputting a position detection signal which is the reference of image formation processing starting timing, a secondary transfer device 36 and a cleaner 38 for cleaning the intermediate transfer belt 26 are arranged around the intermediate transfer belt 26 and a fixing device 40 is arranged on the left side of the secondary transfer device 36 as shown in FIG. 2.

A paper tray 50 is provided at the bottom of the image formation device 10 and a manual feed tray 52 is provided on the right side of the image formation device 10 as shown in FIG. 2. Paper 54 loaded on the paper tray 50 is fed to a carriage path R shown by an alternate long and short dash line in FIG. 2 by a half-moon roll 56 and is carried along the carriage path R by carrier rollers 58, 60 and 62. After carriage through these rollers, paper 54 is carried to the transfer position of the secondary transfer device 36 and an image formed on the intermediate transfer belt 26 is transferred on the paper 54.

The paper 54 on which the image is transferred is carried to the fixing device 40 and fixing processing is executed. The paper 54 on the surface of which the image is fixed by the fixing processing is carried along the carriage path R through carrier rollers 64, 66 and 68 and is ejected on an ejection tray 70. Paper 54 loaded on the manual feed tray 52 is also sent to the carriage path R by a half-moon roll 72 and an image is formed on the surface as described above.

The outline of image formation processing will be described below. First, the developing machine 23Y for a first color, yellow for example is set in a developing position (in a position in which the developing machine is touched to the photoconductor drum 20). The photoconductor drum 20 rotated in a direction shown by an arrow A in FIG. 2 is uniformly electrified by the electrifying device 22 and a yellow latent image is formed on the photoconductor drum 20 by a laser beam from the laser beam emitting part 12. The latent image is developed by yellow toner from the developing machine 23Y.

Switching to the next developing machine is not executed soon even if the developing of yellow is finished and the developing machine 23Y is held in a position opposite to the photoconductor drum 20. Therefore, minute toner is supplied onto the photoconductor drum 20 and the photoconductor drum 20 and the intermediate transfer belt 26 very minutely slip so that the intermediate transfer belt 26 between the primary transfer device 28 and the driving roll 31 is not bent. The minute toner is transferred on the intermediate transfer belt 26, however, in transfer by the secondary transfer device 36, the toner is never transferred on paper 54.

Bias is applied to a developed yellow toner image by the primary transfer device 28 and the developed yellow toner image is transferred on the intermediate transfer belt 26. Toner left on the photoconductor drum 20 without being transferred is removed by the cleaner 30 and the photoconductor drum 20 is deelectrified by a deelectrifying lamp not shown.

Immediately before next developing processing is executed, the developing machine 23M for a second color, magenta for example is set in the developing position by rotating the rotary developing system 24 by 90 degrees. The photoconductor drum 20 is again uniformly electrified by the electrifying device 22 and a magenta image is formed. As described above, the developing of total four colors up to a third color such as cyan and a fourth color such as black is executed and toner images of each color are sequentially transferred on the intermediate transfer belt 26. When the transfer of toner images of four colors on the intermediate transfer belt 26 is completed, a color image is formed on the surface of the intermediate transfer belt 26.

Figure 7:
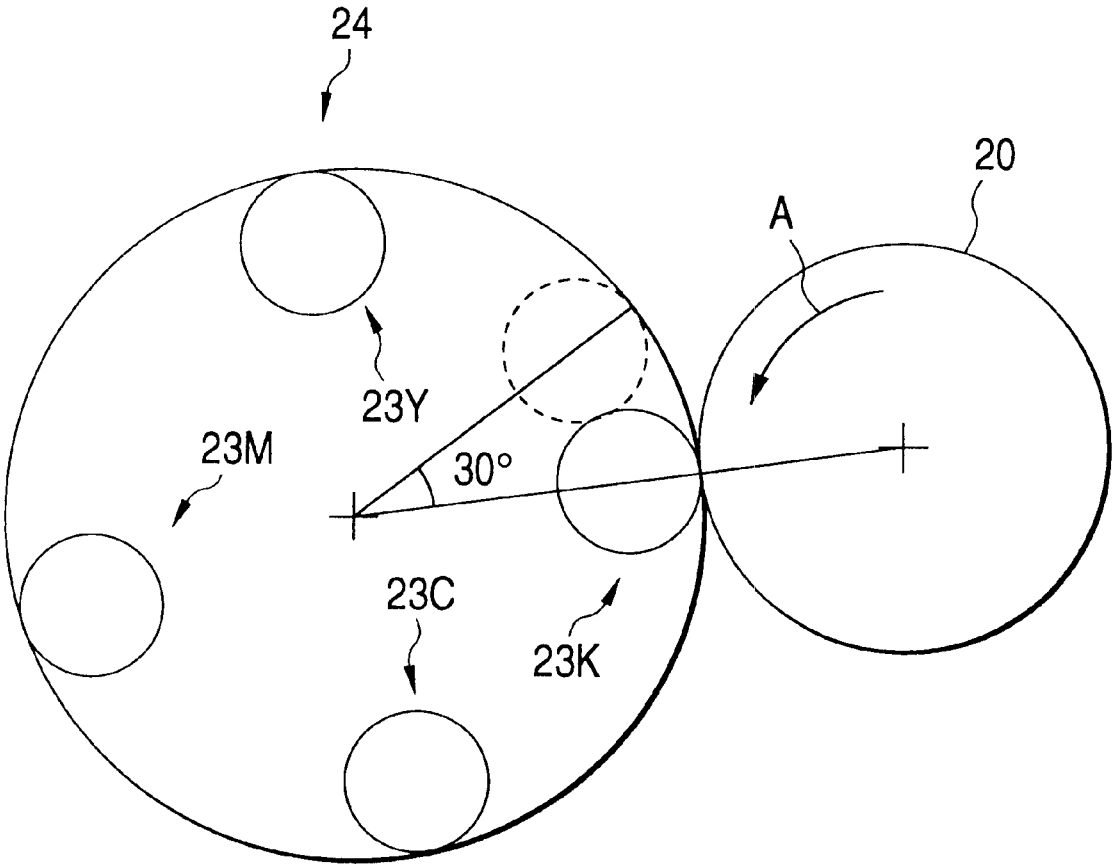
FIG. 7 is an explanatory drawing for explaining a home position for a developing machine.

If plural sheets are printed and the transfer of images of a final page is finished, the developing machine 23K for black is withdrawn to a home position. The home position is located at an angle of approximately 30° from the center of the rotary developing system 24 right and upward with a line connecting the center of the photoconductor drum 20 and the center of the rotary developing system 24 as shown in FIG. 7 (in a position shown by a dotted line in FIG. 7). The angle is not limited to 30° and has only to be an angle at which the photoconductor drum 20 is not touched to a developing machine.

A color image formed on the surface of the intermediate transfer belt 26 is transferred on paper 54 carried along the carriage path R from the paper tray 50 or the manual feed tray 52 by the secondary transfer device 36. The paper 54 on which the color image is transferred is carried to the fixing device 40, is carried between a heating roll 42 heated up to predetermined fixing temperature and a pressurizing roll 44 and the color image is fixed on the paper 54. Hereby, the desired color image is formed on the paper 54.

Next, referring to the drawings, action in an embodiment of the present invention will be described in detail.

First, the developing machine 23Y for the first color, yellow is set in the developing position (in a position in which the developing machine is in contact with the photoconductor drum 20). The photoconductor drum 20 rotated in the direction shown by the arrow A in FIG. 2 is uniformly electrified by the electrifying device 22, a light beam from the laser beam emitting section 12 scans the photoconductor drum 20 and a yellow latent image is formed on the photoconductor drum 20.

FIG. 1 shows a timing chart for explaining the timing of developing processing. FIG. 1 shows time in which a light beam scans the photoconductor drum 20, time required for supplying toner onto the photoconductor drum 20 by the developing machine 23 to develop, time required for switching the developing machines 23, time in which the developing machine 23 is opposite to the photoconductor drum 20 and time required for transferring a toner image formed on the photoconductor drum 20 on the intermediate transfer belt 26 in order from the top.

As shown in FIG. 1, when a light beam from the laser beam emitting section 12 starts to scan the photoconductor drum 20 and a scanning start position reaches the developing position by the rotation of the photoconductor drum 20, the developing of a latent image formed on the photoconductor drum 20 is started by yellow toner from the developing machine 23Y.

When the developed yellow toner image reaches a transfer position by the primary transfer device 28 by the rotation of the photoconductor drum 20, the transfer of the yellow toner image onto the intermediate transfer belt 26 is started.

The application of bias by the primary transfer device 28 is turned off until developing processing for the first color, yellow is started. Therefore, impact caused because the intermediate transfer belt 26 between the primary transfer device 28 and the driving roll 31 is bent until the transfer of a yellow toner image is started and the bent intermediate transfer belt 26 is restored when the transfer is started is never transmitted to the photoconductor drum 20.

Figure 8:
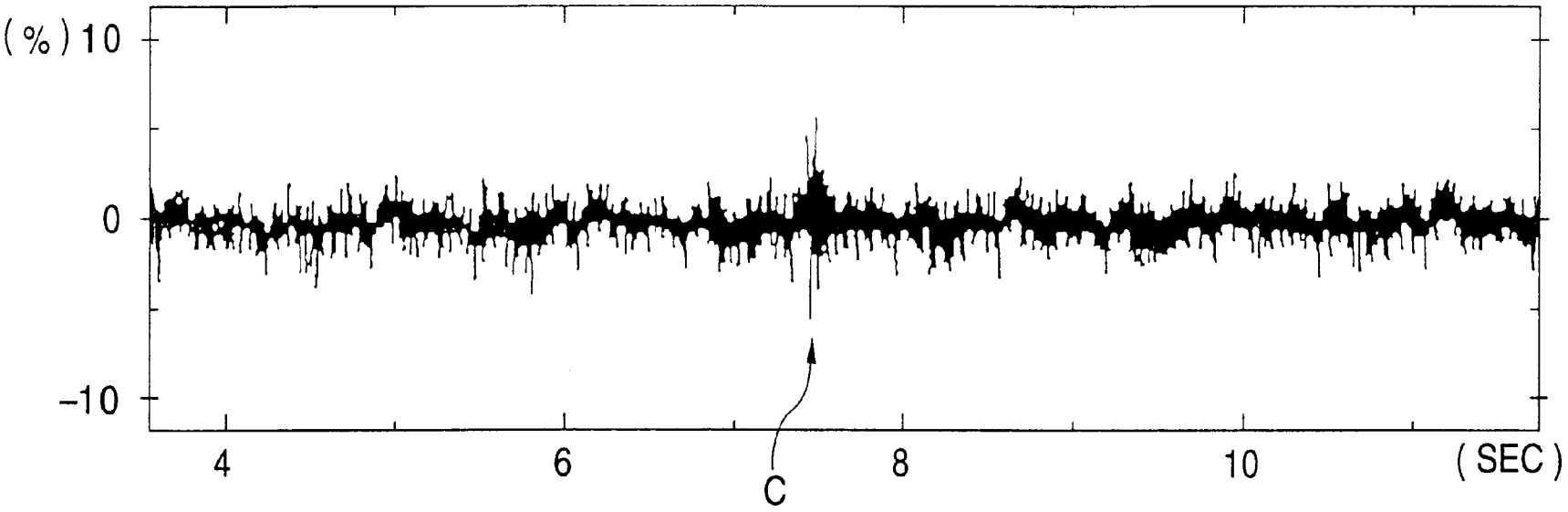
FIG. 8 is a chart showing the degree of impact in switching developing machines according to the present invention and others.
Figure 9:
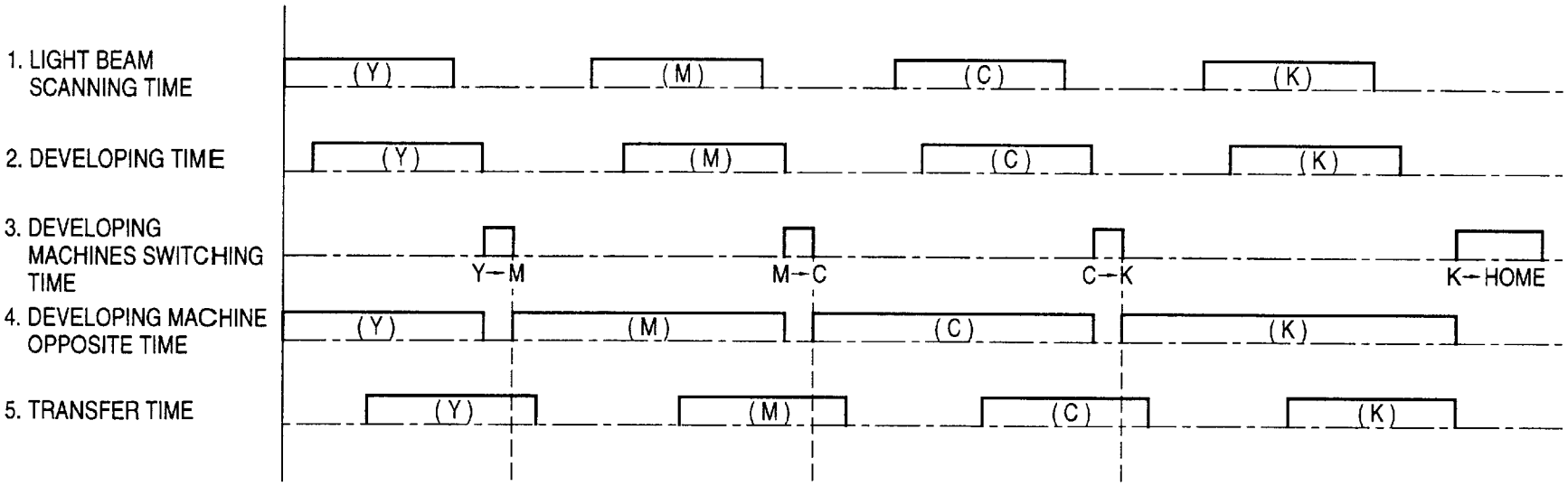
FIG. 9 is a timing chart for explaining timing for switching developing machines according to prior art.
Figure 10:
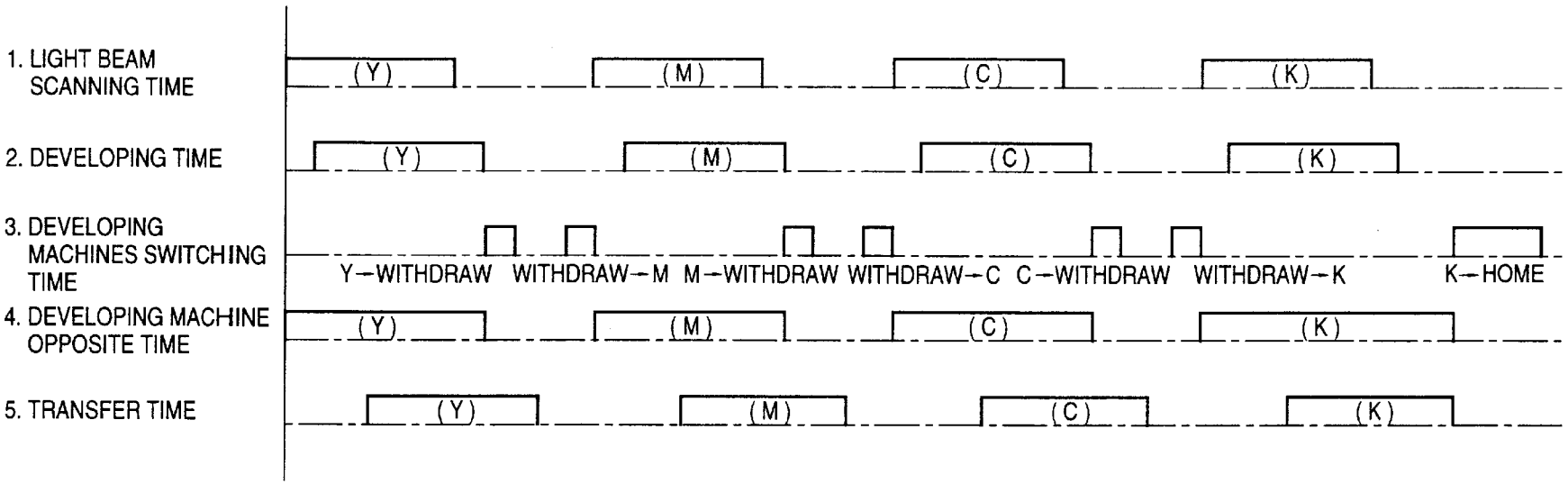
FIG. 10 is a timing chart for explaining timing for switching developing machines according to another prior art.
Figure 11:
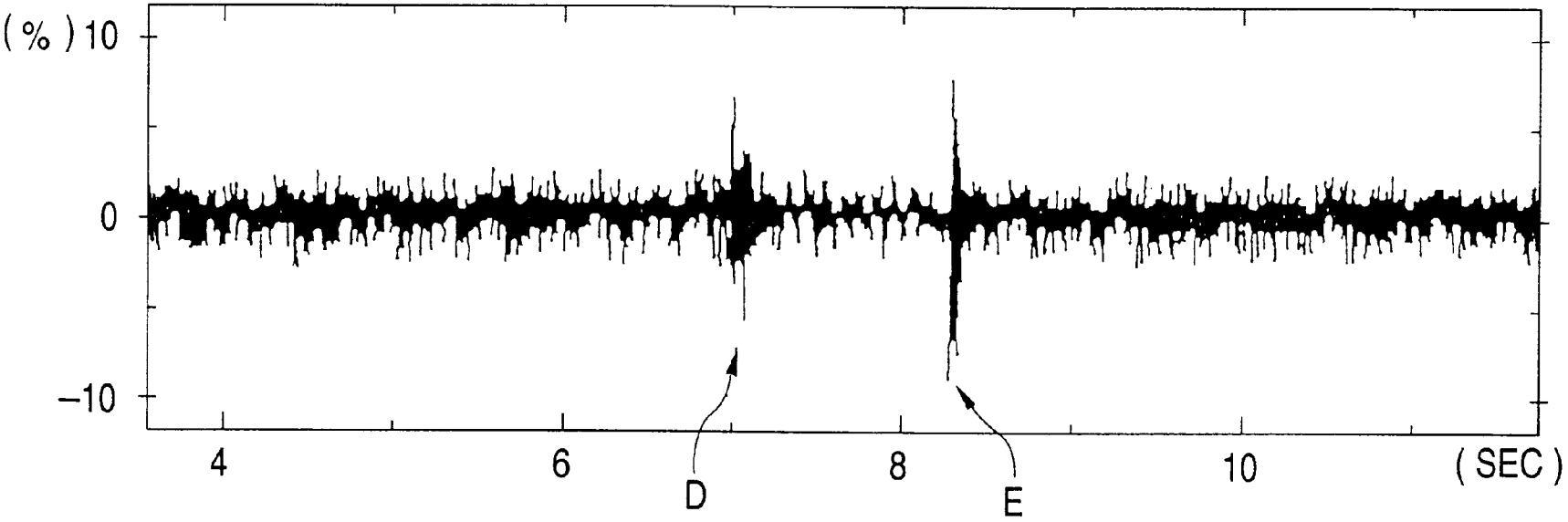
FIG. 11 is a chart showing the degree of impact in switching developing machines according to the prior art and others.
Figure 12:
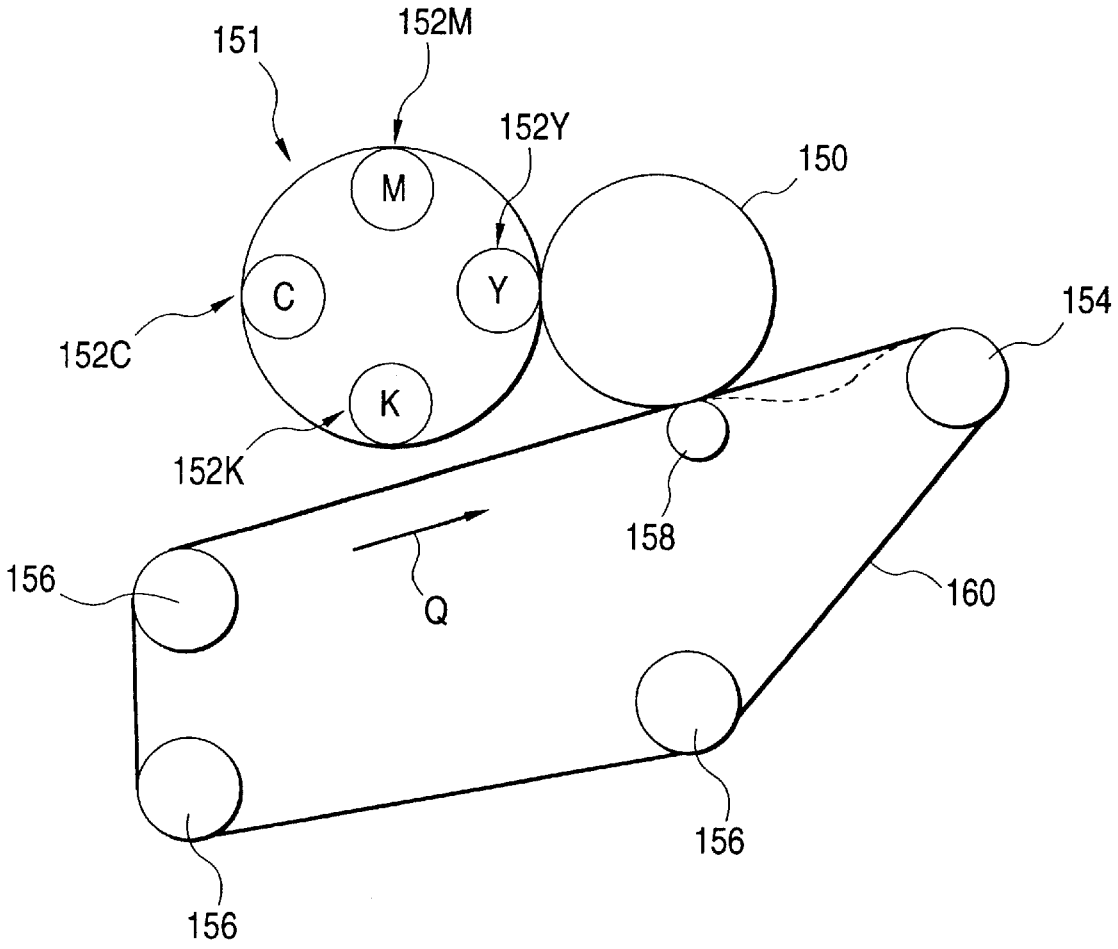
FIG. 12 explains the deflection of an intermediate transfer belt caused between a primary transfer device and a driving roll.

Toner left on the photoconductor drum 20 without being transferred is removed by the cleaner 30. When the transfer of a yellow toner image onto the intermediate transfer belt 26 is finished, the developing machine 23Y is not switched till immediately before the scanning of a light beam corresponding to next magenta is started and is held a state opposite to the photoconductor drum 20. Therefore, as minute toner is supplied to the photoconductor drum 20 and the photoconductor drum 20 and the intermediate transfer belt 26 are held a state in which they minutely slip, the intermediate transfer belt 26 between the primary transfer device 28 and the driving roll 31 is not bent and the effect of oscillation such as that at a point E in FIG. 11 caused heretofore because the bent intermediate transfer belt 26 is restored is never transmitted to the photoconductor drum 20 as shown in FIG. 8. In FIG. 8, the horizontal axis shows time and the vertical axis shows the "degree of impact" (=<velocity upon impact (mm/sec)>/<average velocity (mm/sec)>×100) applied to the photoconductor drum 20 by %.

The developing machine 23M for the second color, magenta is set in the developing position by rotating the rotary developing system 24 by 90 degrees immediately before the scanning of a light beam corresponding to magenta is started. At this time, as shown in FIG. 8, oscillation when the developing roll of the developing machine 23M is touched to the photoconductor drum 20 is transmitted to the photoconductor drum 20 (at a point C in FIG. 8), however, as transfer onto the intermediate transfer belt 26 is not executed at timing (shown by the dotted line in FIG. 1) for switching to the developing machine 23M as shown in FIG. 1, the defect of an image caused by the effect of oscillation in switching is never caused.

When the developing machine 23M is set, the photoconductor drum 20 is again uniformly electrified by the electrifying device 22 and next, a magenta image is formed. As described above, the developing of total four colors up to the third color, cyan and the fourth color, black is executed and toner images of each color are sequentially transferred on the intermediate transfer belt 26. When the transfer of the toner images of four colors onto the intermediate transfer belt 26 is completed, a color image is formed on the surface of the intermediate transfer belt 26.

When the transfer of images of a final page is finished in case plural sheets are printed, the developing machine 23K for black is withdrawn to the home position. As described above, as the developing machine is withdrawn to the home position after the transfer of all colors is finished, oscillation due to the rotation of the rotary developing system 24 has no effect upon the photoconductor drum 20 and the defect of an image is never caused.

A color image formed on the surface of the intermediate transfer belt 26 as described above is transferred on paper 54 carried along the carriage path R from the paper tray 50 or the manual feed tray 52 by the secondary transfer device 36. The paper 54 on which the color image is transferred is carried to the fixing device 40, is carried between the heating roll 42 heated up to predetermined fixing temperature and the pressurizing roll 44 and the color image is fixed on the paper 54. Hereby, the desired color image is formed on the paper 54.

As described above, the defect of an image due to the effect of oscillation in switching the developing machines can be prevented by switching the developing machines immediately before the scanning of a light beam corresponding to the next color is started. Further, as the intermediate transfer belt can be prevented from being bent, the defect of an image can be prevented from being caused by the effect of oscillation caused because the bent intermediate transfer belt is restored.

In this embodiment, a case that the developing machines are switched immediately before the scanning of a light beam corresponding to the next color is started is described as an example, however, the developing machines may be also switched when transfer onto the intermediate transfer belt is finished or at arbitrary time till immediately before the scanning of a light beam corresponding to the next color is started after transfer onto the intermediate transfer belt is finished.

Also, in this embodiment, the multicolor image formation device provided with the developing machines of four colors is described as an example, however, the present invention is not limited to the multicolor image formation device and can be applied to any multicolor image formation device provided with the developing machines of two colors or more.

As described above, according to the present invention, as the developing machines are switched by the switching control means in a while after transfer onto the intermediate transfer belt is finished until the scanning of a light beam corresponding to a color to be developed next is started, the defect of an image caused because oscillation in switching the developing machines is transmitted to the photoconductor can be prevented. Further, as minute toner can be continued to be supplied to the intermediate transfer belt, a minute slip can be always generated between the photoconductor and the intermediate transfer belt and the intermediate transfer belt can be prevented from being bent. Therefore, effect that the defect of an image can be prevented from being caused by the effect of oscillation caused because the bent intermediate transfer belt is restored is produced.

Also, as any of the plural developing machines is withdrawn to a predetermined position in which it is not opposite to the photoconductor by the withdrawal means after color toner images of each chromatic component are all transferred on the intermediate transfer belt, the defect of an image can be prevented from being caused by the effect of oscillation due to the movement of the developing machines.

Figure 13:
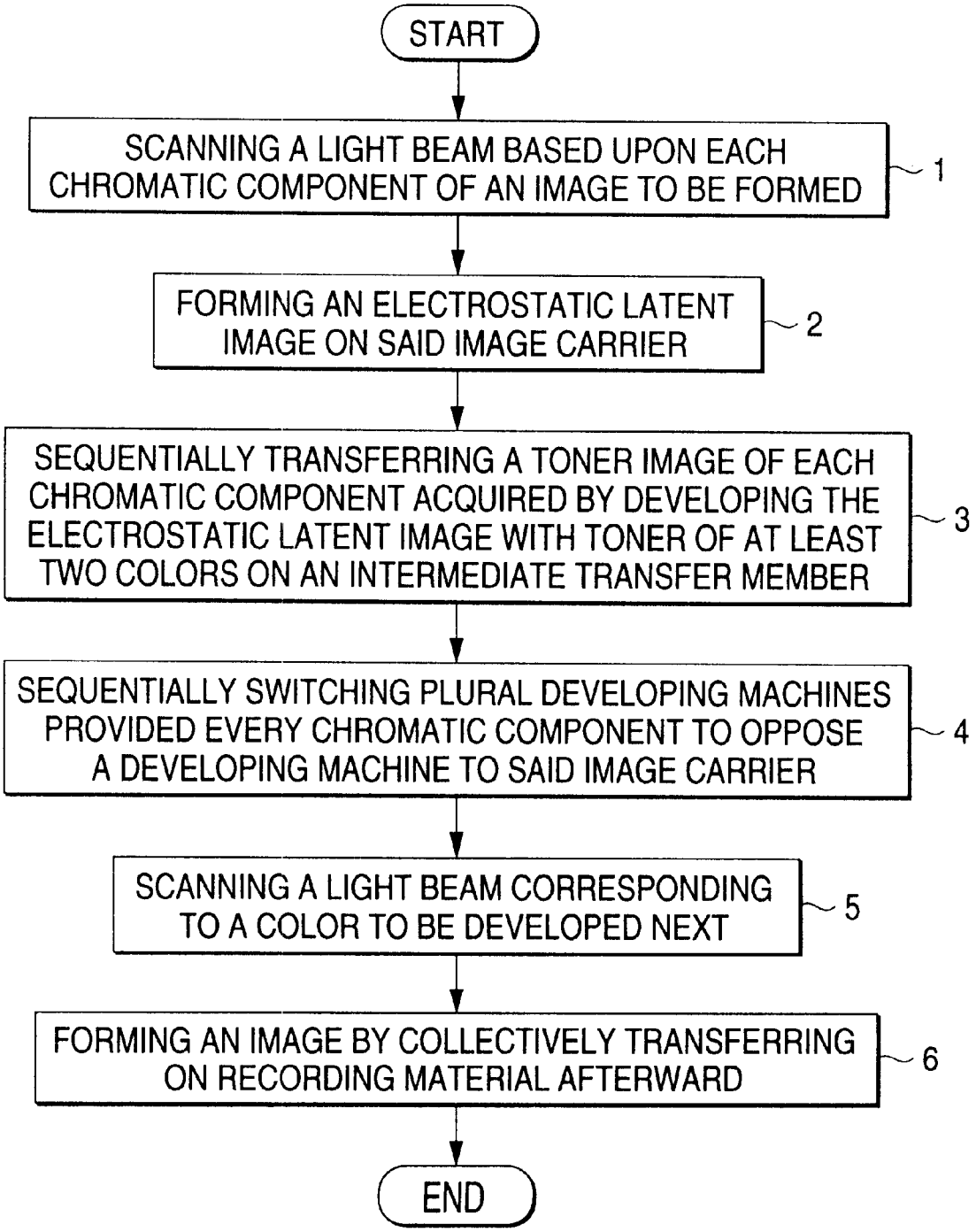
FIG. 13 is a flow chart for showing a multicolor image forming to prevent from an impact caused to a photosensitive drum.

As shown in FIG. 13, the developing machines are switched after transfer onto an intermediate transfer member is finished until scanning a light beam corresponding to a color to be developed next is started so as to prevent an impact caused to a photosensitive drum.

What is claimed is:

1. A multicolor image formation device for forming an electrostatic latent image on an image carrier by scanning a light beam based upon each chromatic component of an image to be formed, opposing a developing machine to said image carrier by sequentially switching plural developing machines provided every chromatic component, sequentially transferring a toner image of each chromatic component acquired by developing said electrostatic latent image with toner of at least two colors on an intermediate transfer member and forming an image by collectively transferring on recording material afterward, wherein:

switching control means for controlling so that said switching of developing machines is executed in a while after transfer onto said intermediate transfer member is finished until scanning a light beam corresponding to a color to be developed next is started.

2. The multicolor image formation device according to claim 1, wherein:

withdrawal means for withdrawing any of said plural developing machines in a predetermined position not opposite to said image carrier after all toner images of said each chromatic component are transferred on said intermediate transfer member is further provided.

3. The multicolor image formation device according to claim 1, wherein:

said intermediate transfer member is a belt without an end.

4. The multicolor image formation device according to claim 1, wherein:

said developing machine is provided with a tracking roll for maintaining a predetermined interval between said developing machine and said image carrier; and said developing machine is touched to said image carrier via said tracking roll by pressing said developing machine by a spring member.

5. The multicolor image formation device according to claim 1, wherein:

said image carrier is a cylindrical photoconductor drum; and one end of said photoconductor drum is fitted to the shaft of a driving motor and supported by the shaft when a housing for supporting the other end of said photoconductor drum so that said photoconductor drum can be rotated is installed in a frame to which the driving motor of said photoconductor drum is fixed.

6. A multicolor image formation method for forming an electrostatic latent image on an image carrier comprising the steps of:

(1) scanning a light beam based upon each chromatic component of an image to be formed, (2) forming an electrostatic latent image on said image carrier, (3) sequentially transferring a toner image of each chromatic component acquired by developing the electrostatic latent image with toner of at least two colors on an intermediate transfer member, (4) sequentially switching plural developing machines provided every chromatic component to oppose a developing machine to said image carrier, (5) scanning a light beam corresponding to a color to be developed next, (6) forming an image by collectively transferring on recording material afterward.

* * * * *